United States Patent [19]

Patton et al.

[11] 4,254,832

[45] Mar. 10, 1981

[54] SAMPLER AND MEASUREMENT APPARATUS

[75] Inventors: Franklin D. Patton; James D. McFarlane, both of West Vancouver, Canada

[73] Assignee: Westbay Instruments Ltd., West Vancouver, Canada

[21] Appl. No.: 960,011

[22] Filed: Nov. 13, 1978

[51] Int. Cl.[3] ..... E21B 33/124

[52] U.S. Cl. ..... 166/332; 166/147; 166/242

[58] Field of Search ..... 166/127, 131, 147, 332, 166/242; 285/351, 423, DIG. 19

[56] References Cited

U.S. PATENT DOCUMENTS

| | | | |
|---|---|---|---|
| 1,510,669 | 10/1924 | Halliday | 166/147 |
| 2,449,642 | 9/1948 | Coons | 166/127 |
| 2,534,528 | 12/1960 | Page | 166/131 |
| 2,924,278 | 2/1960 | Garrett et al. | 166/332 |
| 3,115,188 | 12/1963 | Cochran et al. | 166/332 |

*Primary Examiner*—James A. Leppink

*Attorney, Agent, or Firm*—Fulwider, Patton, Rieber, Lee & Utecht

[57] ABSTRACT

Sampler and measurement apparatus in the form of a tube having opposite ends to be used with casings axially aligned therewith to form a common passageway through which can be moved instruments for taking samples and/or measurements, and operating tools. At least one port is formed in the tube spaced from the ends thereof. A sleeve slidably mounted in the tube is movable longitudinally thereof between one position covering the port and another position uncovering it.

6 Claims, 6 Drawing Figures

SAMPLER AND MEASUREMENT APPARATUS

FIELD OF THE INVENTION

This invention relates to apparatus for use with casing assemblies for taking samples and/or measurements in wells or bore holes, tanks and the like at a plurality of different depths.

This apparatus makes it possible to take samples or to take measurements, such as pressure and temperature measurements, at any desired number of different levels. The apparatus can be used in a body of water, such as a river or lake, in a tank, or in a well or bore hole in the ground. In addition to this, fluid can be directed out of the apparatus at the different levels.

DESCRIPTION OF THE PRIOR ART

It is common for measurements, such as fluid and gas measurements, to be made at one or two different levels in a single bore hole, and occasionally as many as four different levels are monitored in a single hole. However, in these cases, separate casing or individual hydraulic or pneumatic tubes are required to reach the different locations, but there is a practical limit of about three or four installations that can be successfully placed in a single bore hole. Another current method of taking measurements at different levels in a single bore hole is to install electrical or electronic devices in the hole. However, there is a practical limit to the number of such devices that can be successfully installed and sealed in a bore hole, and these devices are very susceptible to errors during long term monitoring programs as moisture seals tend to leak thereby disturbing the electric or electronic circuitry. These devices are also susceptible to damage from lightning discharges. Existing pneumatic and electrical or electronic devices cannot easily be checked or recalibrated following installation. As a result, the quality of their data cannot be verified.

When currently available pneumatic, electrical and electronic measuring devices are sealed in a bore hole, fluid or gas samples cannot be taken. Therefore, another well must be drilled for fluid or gas sampling. Fluid or gas samples are often taken at different levels in bore holes or bodies of water for analysis of the quality or chemical composition at these levels. However, known methods of sampling do not permit a large number of sampling points down the hole or in the water.

In lakes and rivers, water sampling points should be reoccupied as closely as possible as to depth and location for repetitive tests for samples to be clearly comparable. In addition, the sampling apparatus should have a negligible effect on the existing hydrologic environment during the sampling process.

SUMMARY OF THE INVENTION

The present apparatus makes it possible to take samples and/or measurements at as many different levels as required in a single well or bore hole or in a body of liquid. The apparatus permits the taking of large volume samples at each different level in a short time. The apparatus is used in conjunction with instruments for doing the desired jobs, that is, taking samples, measuring temperatures or pressures, measuring pH or eH values, or other physical and chemical conditions.

In addition, the apparatus is used in conjunction with tools for opening and closing the apparatus relative to the surrounding environment at the different levels.

Sampler and measurement apparatus in accordance with this invention is used with casing axially aligned therewith when in use to form a common passageway through which can be moved instruments for taking samples and/or measurements, and operating tools, this apparatus comprising a tube having open ends for registering with and connection to axially aligned tubular casings, at which time the interior of said tube forms a common passageway with the casings through which instruments and operating tools can be moved, port means in the tube spaced from the ends thereof and through which fluid can move into or out of the tube respectively into or out of an instrument or probe in the passageway, and closure means in the tube for said port means, said closure means being operable by a tool moved through the passageway to open and close the port means.

More specifically, the apparatus according to the present invention comprises a tubular body having opposite ends for registering with and connection to axially aligned tubular casings, at which time the interior of said body forms a common passageway with the casings through which instruments and operating tools can be moved, at least one port in the body spaced from the ends thereof, and a closure sleeve slidably fitting in the tubular body and movable longitudinally thereof, said sleeve being movable by a tool moved through the passageway to cover and uncover the port.

BRIEF DESCRIPTION OF THE DRAWINGS

The present invention is illustrated by way of example in the accompanying drawings, in which.

DESCRIPTION OF THE PREFERRED EMBODIMENTS

Figure 1:
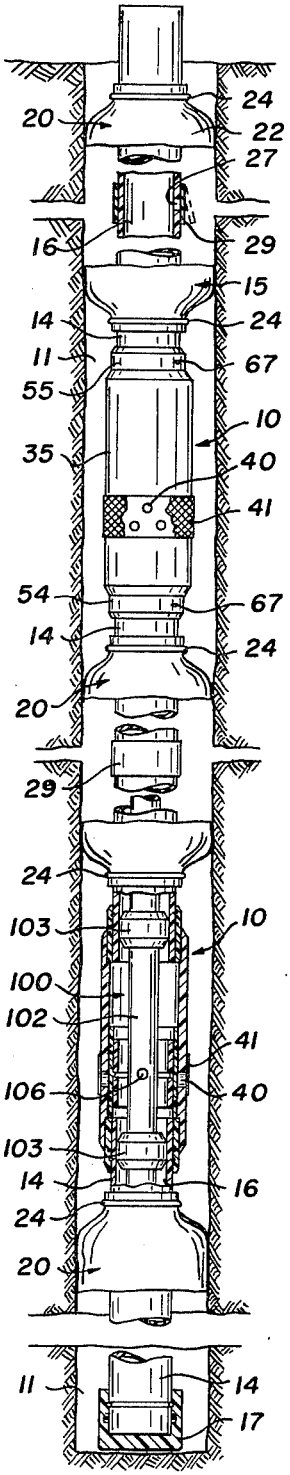
FIG. 1 digrammatically illustrates sampler and measurement apparatus interconnecting adjacent ends of axially aligned casings.

Referring to FIG. 1 of the drawings, a sampler and measurement apparatus 10 according to this invention is shown in the well or bore hole 11. The apparatus 10 is connected at opposite ends to axially aligned casings 14, and these form a casing assembly 15 having a common or continuous passageway 16 extending from the top to the bottom of well 11. If desired, the lower end of the lowermost casing 14 may be closed by a cap 17. Each apparatus 10 and the casings 14 connected to the upper and lower ends thereof form a complete working combination, and there are any number of these combinations forming the casing assembly in the well, this number depending upon the depth of the well and the number of levels at which samples or measurements are to be taken.

Each casing 14 forms part of a packer 20 which includes an expandable cylindrical packer tube, membrane or bag 22 formed of suitable elastic material, such as natural or synthetic rubber or plastic such a urethane. Urethane is preferable for this purpose because it is readily moldable, and has high strength and abrasion characteristics when expanded. The casing 14 extends through and beyond the ends of the bag, and said bag is clamped at its opposite ends to the casing by circular fasteners or clamps 24.

A port 27 in casing 14 within tube or bag 22 may under some circumstances be left open, but normally is closed by a check valve 29. In this example, valve 29 is in the form of a wide elastic band extending around the casing and over port 27. After the total casing assembly has been inserted in well 11, the tubes or bags 22 of packers 20 are inflated or expanded by directing a fluid, such a air or water, into the respective bags through the valve-controlled ports 27 thereof. The valves 29 open under internal pressure to permit fluid to flow into the packer tubes, and close when the internal pressure is released and when they are subjected to external pressure greater than the internal pressure. If desired, bags 22 may contain a material, such as cement or grout, which hardens or sets when water or other suitable liquid is directed into the bags. Alternatively, settable cements or grouts may be injected into the bags 22 to permanently inflate the bags.

Figure 2:
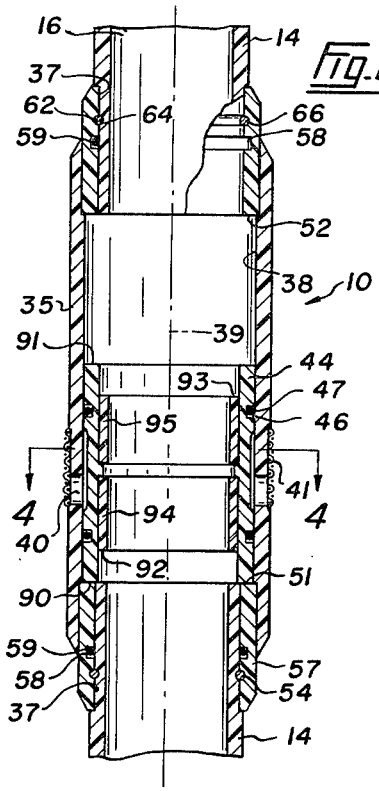
FIG. 2 is an enlarged vertical section through a sampler and measurement apparatus, showing the ports thereof.
Figure 3:
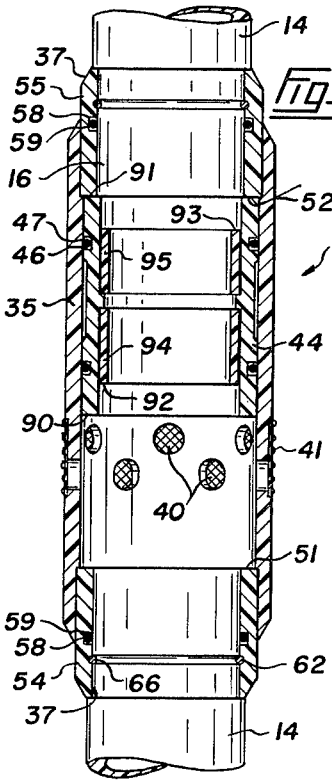
FIG. 3 is a view similar to FIG. 2 but showing the ports open.
Figure 4:
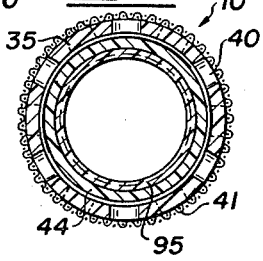
FIG. 4 is a cross section taken on the line 4—4 of FIG. 3, FIG. 5 diagrammatically illustrates an instrument in the apparatus for opening and closing the ports thereof.

FIGS. 2, 3 and 4 illustrate the sampler and measurement apparatus 10 in detail. This apparatus includes a tube or tubular body 35 having opposite open ends 37 which register with and are connected to adjacent ends of two successive casings 14 of the assembly 15. The interior or bore 38 of tube 35 is axially aligned with the interiors of the adjacent casings 14 and is on a common central axis 39 therewith and forms part of the common passageway 16. The diameter of bore 38 is greater than the inner diameter of casings 14. Port means are provided in tube 35 spaced from the ends thereof. This port means is made up of at least one port which preferably is relatively large. In this example, the port means is made up of a plurality of radial ports 40 which are circumferentially spaced apart all the way around the tube. In the illustrated example, the ports 40 are arranged in two rows, with the ports of one row staggered in relation to the ports of the other row. If desired, a metal, fabric or plastic screen 41 or other filter material may be placed over ports 40.

The tube 35 also includes closure means for the port means, said closure means being operable by a suitable tool moved through the passageway 16 to open and close the port means. In the preferred form of the invention, the closure means is in the form of a closure sleeve 44 slidably mounted in the bore 38 of the tube for axially movement therein. This sleeve is movable between a position covering and closing ports 40, shown in FIG. 2, and a position uncovering or opening said ports, as shown in FIG. 3. Sleeve 44 has annular grooves 46 in its outer surface adjacent its opposite ends, each of these grooves having a sealing ring 47 therein. When the sleeve 44 is in the closed position, the sealing rings 47 which bear against the inner surface of tube 35 are located above and below the ports 40. A first stop 51 is provided in tube or body 35 near one end of bore 38 thereof, said stop being so spaced in one axial direction away from ports 40 that when sleeve 44 engages said stop the ports are covered as in FIG. 2. A second stop 52 is provided within tube or body 35 adjacent the opposite end of bore 38, said second stop being so spaced in the opposite axial direction away from the ports that when the sleeves engages the latter stop, the ports are uncovered as in FIG. 3. Stops 51 and 52 are formed by stop sleeves 54 and 55, respectively, fixedly secured in the body or tube 35 at the ends 37 thereof. Actually, sleeves 54 and 55 form the effective ends of tube 35.

Suitable connecting and sealing means is provided between each end of tube 35 and the adjacent end of a casing 14. In this example, the sealing connecting means is provided in the stop or end sleeves 54 and 55. Each sealing connecting means includes an annular groove 58 in the inner surface of either sleeve 54 or sleeve 55, and containing a sealing ring 59. This ring receives and fits tightly around the end of a casing 14 which fits within the stop sleeve. If desired, the groove 58 may be formed in the outer surface of casing 14, in which case the sealing ring 59 would bear against the inner surface of the stop sleeve. The groove 58 is spaced inwardly from the adjacent end of its sleeve. Another annular groove 62 is formed in the inner surface of stop sleeve 54 or 55 between groove 58 and the adjacent tube end, groove 62 overlying and registering with a similar annular groove 64 formed in the outer surface of the adjacent casing 14. A flexible shear fastener 66 extends through the registering annular grooves 62 and 64 to lock tube or body 35 and the casings together. This fastener is inserted into and removed from the registering grooves 62, 64 through an orifice 67 in sleeve 54 or 55 and communicating with said grooves, see FIG. 1. The fastener 66 may be in the form of a flexible wire, strand or cord which is strong enough to prevent relative longitudinal movement between the coupler tube and the casing. The connecting and sealing means may also be achieved by normal male and female pipe threads and gaskets between each end of tube 35 and the adjacent end of a casing 14.

Figure 5:
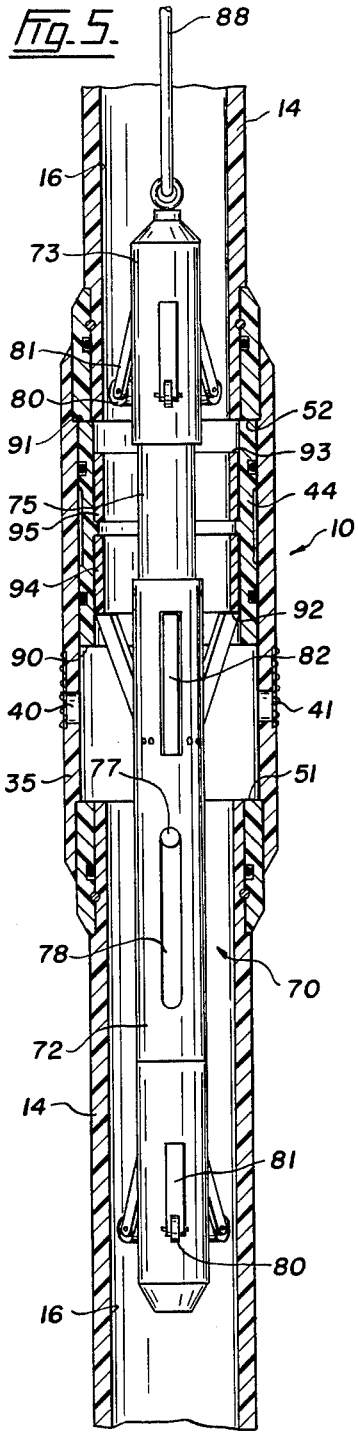
Figure 6:
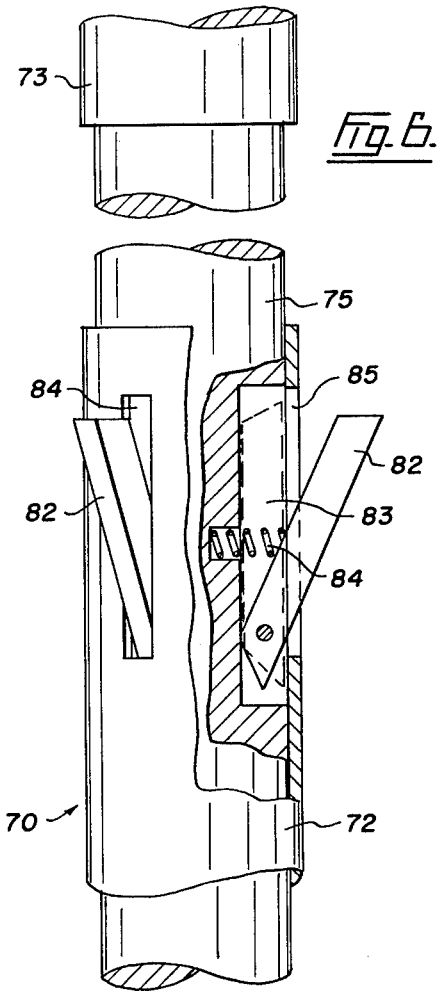
FIG. 6 is an enlarged fragmentary sectional view of a portion of the instrument shown in FIG. 5.

FIGS. 5 and 6 illustrate by way of example, a tool 70 that can be moved through passageway 16 in the casing assembly and operated to open and close the ports of each apparatus 10 within the assembly. The illustrated tool 70 is made up of a tubular main section 72 and an extensible end section 73. The end section 73 includes a rod 75 which slidably fits into the tubular main section 72, and a pin 77 projecting laterally from this rod slides in a slot 78 in the main section to limit the endwise movement of the rod and the end section 73. The tool 70 is provided with a plurality of rollers 80 on the outer ends of arms 81 which are pivotally mounted on and project from the tool and which are spring loaded in an upward direction so that these rollers ride against the surface of passageway 16 as the tool is moved up and down through the passageway.

A plurality of stop arms 82 are pivotally mounted at inner ends in slots 83 formed in shaft or rod 75 and are biased outwardly by springs 84 through adjacent slots 85 formed in the tubular main section 72. When the end section 73 is extended, as shown in FIGS. 5 and 6, the arms 82 are inclined outwardly relative to tool 70, but when said end section is retracted, rod 75 moves relative to the main section 72 so that the ends of slots 85 engage the stop arms 82 and swing these inwardly into their slots 83 so that they no longer project from the tool. Tool 70 is suspended within the passageway of the casing assembly by a flexible cable 88 which is connected to the upper end of the end section 73.

The closure sleeve 44 is provided on its inner surface with a first shoulder 90 spaced from and facing in the direction of first stop 51, and with a second shoulder 91 facing in the opposite direction towards second stop 52.

Third and forth shoulders 92 and 93 adjacent and spaced inwardly from shoulders 90 and 91, respectively, are provided on the inner surface of sleeve 44. The shoulders 92 and 93 are formed respectively by annular bands 94 and 95 fixedly mounted on the inner surface of the sleeve. The inner diameters of bands 94 and 95 are the same as the inner diameters of casings 14 and constitute the effective inner diameter of the sleeve 44. With this arrangement, when the tool 70 is moved through the tubular body 35, the rollers 80 of the tool engage the inner surfaces of bands 94 and 95 and are guided thereby through the closure sleeve.

As a rule, when the casing assembly is inserted into the well or bore hole 11, the sleeve 44 of each sampler and measurement apparatus 10 is in engagement with stop 51 so that the sleeve is covering or closing the ports 40 thereof. When it is desired to open the ports of a given apparatus 10, the tool 70 is lowered by cable 88 through passageway 16 until it is located below but near the selected apparatus. At this time, the end section 73 of the tube is extended as in FIG. 5 so that the stop arms 82 are inclined outwardly and upwardly relative to the tool. These outwardly biased arms slide against the irregularities of the surface of the passageway. Following this, tool 70 is raised until the arms 82 engage shoulder 92 of the sleeve 44 of the selected body or tube 35. Continued upward movement of the tool moves the sleeve 44 with it until the latter engages stop 52, at which time the sleeve is clear of ports 40 so that the latter are open. When it is desired to remove tool 70 from the passageway, the tool is lowered until it engages the bottom of well 11 or cap 17 if the latter is used, at which time the downward momentum of end section 73 and rod 75 causes the arms 82 to retract or swing inwardly of the tool so that the latter may now be lifted to the top of the assembly.

When it is desired to close ports 40, a tool similar to tool 70 is used, but this closing tool is the reverse of opening tool 70. In the latter closing tool, the stop arms are downwardly inclined and are retained within the tool when the lower end of the tool is extended, this lower end being the same as the tool end 73 described above. When the tool engages the bottom of the well or cap 17, the lower end is retracted to allow the stop arms to swing outwardly and downwardly. Then the tool is drawn upwardly until it is just above the desired tube 35, and when the tool is lowered the stop arms engage shoulder 93 to move the sleeve 44 downwardly until shoulder 90 engages stop 51, thereby closing ports 40, as shown in FIG. 2. If sleeve 44 does not move to close the ports under the weight of tool 70, it can be hammered to the closed position by lifting on cable 88 and dropping the probe gently several times.

As stated above, there is sampler and measurement apparatus 10 at each of a plurality of levels in the casing assembly when the latter is located in a well, bore hole, body of water, tank or the like. Samples or measurements may be taken at any selected level with little or no interference from conditions at the other levels. When the casing assembly is in use in a well or bore hole the packer bags isolate each apparatus 10 from similar apparatus at other levels. The instrument for taking a sample or measurement is designed to do the desired job. An instrument 100 is diagrammatically illustrated in FIG. 1 for this purpose. The instrument 100 consists of a tube 102 having small expandable packer bags 103 thereon and spaced from each other sufficiently to fit into casings 14 above and below the measurement apparatus 10. Bags 103 slide through the bands 94 and 95 in sleeve 44 and are guided thereby through said sleeve. These packer bags are expanded and contracted by fluid passing down through tube 10 in the well-known manner. At least one port 106 in tube 102 is located so as to be near ports 40. When ports 40 are open, liquid can be drawn through these ports and through port 106 into tube 100. Similarly, if desired, liquid can be ejected through ports 106 and through ports 40 into the surrounding material. The instrument 100 is a known type and may have therein suitable pumping means, temperature and other measuring means, and one or more sample containers. As the construction and operation of instrument 100 does not form part of the present invention, it does not require any further explanation herein.

We claim:

1. Sampler and measurement apparatus for use with casings having a predetermined inner diameter and axially aligned therewith when in use to form a common passageway through which can be moved instruments for taking samples and/or measurements, and operating tools, said apparatus comprising a coupler in the form of a tubular body having opposite open ends having annular inner surfaces and into which ends of axially aligned tubular casings can fit, said body having an inner bore of a diameter greater than said casing inner diameter and on a common axis with the casings, connecting and sealing means at the ends of the tubular body for connecting and sealing said ends to the aligned casings, at which time the bore of said body forms a common passageway with the casings through which instruments and operating tools can be moved, said connecting and sealing means at each of said ends of the tubular body comprising a first annular groove in the annular inner surface of tubular body, a sealing ring in the annular groove to receive and tightly fit around a casing end, a second annular groove in the annular inner surface of the tubular body spaced outwardly in an axial direction from the first groove, and a flexible shear fastener in said second groove adjusted to fit in an overlying groove in said casing end to lock said casing and the tubular body together, port means in the body spaced from the ends thereof, a closure sleeve slidably fitted in the bore of the tubular body and movable longitudinally thereof, said sleeve having an inner effective diameter the same as the casing inner diameter, said sleeve being movable by a tool moved through the passageway to cover and uncover the port, a first stop in the bore of the body near an end thereof and so spaced in one axial direction away from the port means that when the sleeve engages said first stop, the port means is covered, and a second stop in the bore of the body near an opposite end thereof and so spaced in the opposite axial direction away from the port means that when the sleeve engages said second stop, the port means is uncovered.

2. Sampler and measuring apparatus as claimed in claim 1 comprising two shoulders in the sleeve facing axially in opposite directions to be engaged by the tool to enable the latter to move the sleeve.

3. Sampler and measuring apparatus as claimed in claim 1 comprising a first shoulder in the sleeve facing towards said first stop, and a second shoulder in the sleeve facing towards said second stop, said first and second shoulders being engageable by said tool to enable the latter to move the sleeve respectively to uncover the port means and cover said port means.

4. Sampler and measurement apparatus for use with casings having a predetermined inner diameter and axially aligned therewith when in use to form a common passageway through which can be moved instruments for taking samples and/or measurements, and operating tools, said apparatus comprising a coupler in the form of a tubular body having opposite open ends for registering with axially aligned tubular casings, said body having an inne bore of a diameter greater than said casing inner diameter and on a common axis with the casings, connecting and sealing means at the ends of the tubular body for connecting and sealing said ends to the aligned casings, at which time the bore of said body forms a common passageway with the casings through which instruments and operating tools can be moved, port means in the body spaced from the ends thereof, a closure sleeve slidably fitting in the bore of the tubular body and movable longitudinally thereof, said sleeve having an inner effective diameter the same as the casing inner diameter, said sleeve being movable by a tool moved through the passageway to cover and uncover the port, a first stop in the bore of the body near an end thereof and so spaced in one axial direction away from the port means that when the sleeve engages said first stop, the port means is covered, a second stop in the bore of the body near an opposite end thereof and so spaced in the opposite axial direction away from the port means that when the sleeve engages said second stop, the port means is uncovered, a first annular band fitting in the sleeve and forming a first shoulder in the sleeve facing towards said first stop, and a second annular band fitting in the sleeve and forming a second shoulder in the sleeve facing towards said second stop, said first and second annular bands having inner diameters the same as the casing inner diameter and constituting the effective inner diameter of the sleeve, and said first and second shoulders being engageable by said tool to enable the latter to move the sleeve respectively to uncover the port means and cover said port means.

5. Sampler and measuring apparatus as claimed in claim 1 or 4 in which said port means comprises a plurality of circumferentially spaced radial ports in the body.

6. Sampler and measurement apparatus as claimed in claim 4 comprising annular grooves in the outer surface of the closure sleeve on opposite sides of and spaced from the port means thereof, and a sealing ring in each of said annular grooves slidably bearing against the inner surface of the closure sleeve.

* * * * *